US005553943A

United States Patent [19]

Cook et al.

[11] Patent Number: 5,553,943

[45] Date of Patent: Sep. 10, 1996

[54] MULTIPLE PLY PLASTIC LINED BAG WITH SATCHEL BOTTOM

[75] Inventors: Leland B. Cook; Ronald G. Thrall, both of Vancouver, Wash.

[73] Assignee: Bemis Company, Inc., Minneapolis, Minn.

[21] Appl. No.: 363,515

[22] Filed: Dec. 23, 1994

[51] Int. Cl.[6] ..... B65D 30/26; B65D 30/14

[52] U.S. Cl. ..... 383/113; 383/94; 383/111; 383/126

[58] Field of Search ..... 383/113, 126, 383/111, 88, 79, 94

[56] References Cited

U.S. PATENT DOCUMENTS 3,412,925 11/1968 Booth et al. ..... 383/113
3,473,446 10/1969 Berghracht ..... 383/126 X
3,929,275 12/1975 Bolling et al. .
4,498,192 2/1985 Becker et al. ..... 383/126
5,281,027 1/1994 Thrall .

FOREIGN PATENT DOCUMENTS 2754658 6/1979 Germany ..... 383/113

*Primary Examiner*—Jes F. Pascua
*Attorney, Agent, or Firm*—Lee, Mann, Smith, McWilliams, Sweeney & Ohlson

[57] ABSTRACT

A multiple ply open mouthed bag with a rectangular satchel bottom having a plurality of tubular paper plies enclosing a seamless inner plastic pouch capable of heat sealing and/or severance at said open mouth. The paper plies may be made capable of pinch, sewn, or other various closures at said open mouth. The plastic pouch being foldably, non-adhesively and detachably arranged at the satchel bottom of the bag. The satchel bottom being formed by the slitting, folding and overlapping of stepped paper plies adhesively bonded thereat to form the satchel bottom and to loosely retain said pouch independently and away from said adhesive bonding.

22 Claims, 8 Drawing Sheets

BACK
FRONT
14
22
16
18
20
12
12a
12b
44
46
48
50
52
54
56
38
40
42
G
L

MULTIPLE PLY PLASTIC LINED BAG WITH SATCHEL BOTTOM

BACKGROUND OF THE INVENTION

The invention relates to an open-mouthed bag having a multiple paper ply construction with a sealable plastic liner.

More specifically, the invention is directed to a type of bag having a satchel bottom with the paper plies adhesively attached but freely foldably retaining the bottom of a plastic liner or pouch at the satchel bottom end of the bag. The opposite end of the bag is open and conventionally constructed to allow for the heat sealing of the plastic liner when filled, and the subsequent severing thereof, thereby rendering the plastic liner detachably removable from the bag. The paper plies at the open end of the bag may be provided in a stepped construction for adhesive bonding after being folded in a pinched closure but might otherwise be flush cut for a sewn closure, including an optional tear strip, or have other forms of known closures.

The invention is also related to providing a bag that is tubular and as a blank may be stacked in a flat condition for later use by the packager, wherein the plastic pouch and multiple ply papers at the bottom of the bag are cooperative so that the bag may be filled with a product, such as dry granulated powder, without tearing the plastic liner. The satchel end of a filled bag would preferably have a flat rectangular bottom.

The invention is more specifically aimed at providing a satchel bottom polyethylene ("poly") lined bag that eliminates the sharp comers inherent in conventional pinch bottom open mouthed (PBOM) type of closures for tubular bags, so that when the bags are filled and stacked on a pallet, they achieve relatively smooth pallet edges and will not puncture the usual load-securing plastic stretch wrapping that envelops a loaded pallet. This also renders the bag less susceptible to impact damage otherwise experienced at the pointed corners of PBOM bags if contacted by other objects, such as when roughly handled by a forklift truck during stacking and unstacking.

The invention also provides for a plastic liner construction as in U.S. Pat. No. 5,281,027, so that the bag may be formed on conventional stepped tubing equipment. The present bag, however, provides for forming a sealed bottom end of a plastic liner that is folded at a multiple ply paper satchel bottom in a freely folded relation therewith. Accordingly, the present invention is an improvement in the art and upon this patented bag, which utilize a pinch bottom non-satchel closure.

The invention additionally overcomes the prior art deficiencies as found in the satchel bottom bag disclosed in U.S. Pat. No. 3,929,275. This patent provides a straight-cut, non-stepped bottom for the paper plies wherein all the paper layers are slit. It also does not show marginal offsetting at a plastic liner in a stepped multi-paper ply satchel bottom bag to prevent pinholing or rupture during filling. Contrarily, in the present invention, the innermost paper ply adjacent the plastic liner is not slit. The innermost paper ply thereby offers an underlying reinforcing and rigidifying continuous lower edge when folded into the satchel closure.

Another known satchel bottom bag utilizing a plastic liner is provided by Stone Container Corporation in a bag identified as PEELPACK. This bag does not slit any of the multiple paper plies and therefore does not achieve the effective geometric multi-zone gluing pattern for the paper plies as in the present invention.

The prior art also has taught the use of gussetted bags that form a square bottom and achieve a fairly acceptable configuration on a pallet to avoid damage. However, the industry has the need for filling satchel bottom bags on the same filling equipment as used for flat tubular PBOM bags. Gussetted bags must be filled on different types of fillers. This is because gussetted bags do not have a flat tubular construction and therefore are incapable of being filled on the flat tube bag filling equipment.

The invention also has the goal of providing a plastic liner for a tubular flat bag that is heat sealable and able to be folded flat in a loose arrangement for a satchel bottom bag rather than a PBOM bag.

The present invention satisfies the above needs and overcomes the deficiencies in the prior art as will be described in greater detail hereinafter.

SUMMARY OF THE INVENTION

The multiple ply plastic lined bag with satchel bottom in accordance with the present invention provides a secure package for products, or commodities, and has a sealed inner plastic liner or pouch enclosed within multiple removable paper plies. The inner pouch is sealed at the top after filling and may be severed, so that it is freely held within the paper plies. The bottom of the bag is a satchel bottom closure, wherein the paper plies are stepped, slit, folded and adhesively attached together. An innermost paper ply is not slit and forms a pouch-adjacent paper ply, which is folded to trapezoidal shapes at opposite sides of the bottom and folded against itself under the other paper plies to form a strong, supportive inner ply of the satchel bottom. During forming, the plastic liner, which is heat sealed at the satchel end, is folded away from a main transverse score line of the satchel bottom, so that upon making the adhesive closure of the paper plies, it is folded within, but non-adhesively held, by the paper plies. Thereby, during the later filling of the bag, the bottom of the plastic liner may freely detach from the paper and be filled without rupturing or pinholing. The plastic liner has a width less than one-half of the perimeter of the inner paper ply, thereby providing marginally offset edges, as shown in my U.S. Pat. No. 5,281,027. The inventive bag has a non-gussetted construction wherein only the inner paper ply is not slit, but the paper ply or plies that overlie the inner paper ply are longitudinally slit for enhanced adhesive securement for the satchel bottom.

The invention is further characterized as providing the capability of being filled on a tubular PBOM bag filler, which cannot be accomplished using the prior art satchel bottom bags which require a gussetted construction. The present invention therefore retains the beneficial internal features for a plastic pouch as shown in my said patent with respect to the reduction of damage during filling and the elimination of pinching or pinholing along the lateral edges and bottom corners.

At the opposite, open end of the bag, any type of bag closure may be provided, such as sewn, adhered, taped, stapled, etc. Preferably, the closure would allow for the plastic pouch to be heat sealed and severed, so it freely and detachably resides as a bag-in-a-bag. The invention also permits the inner plastic pouch to be as long as the paper plies during filling, as in my patent noted above, but also offers the benefits of a satchel bottom. All these improvements are reached while still retaining the easy removal of the pouch from the outer paper plies by the ultimate customer receiving the packaged product.

BRIEF DESCRIPTION OF THE DRAWINGS

FIG. 1 is a perspective view of the multi-ply plastic lined bag with satchel bottom, partially broken away, and having a pinch closure-type open top ready to be filled by the packer with a commodity or the like;

Figure 6:
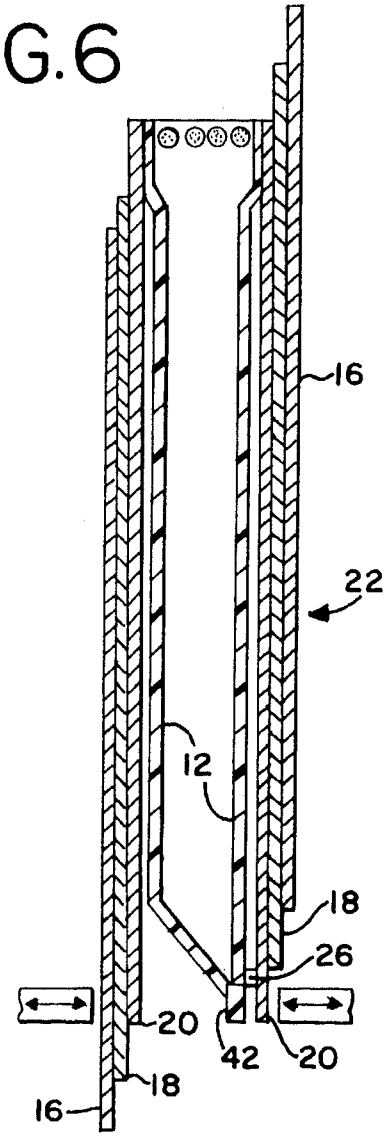
Figure 5:
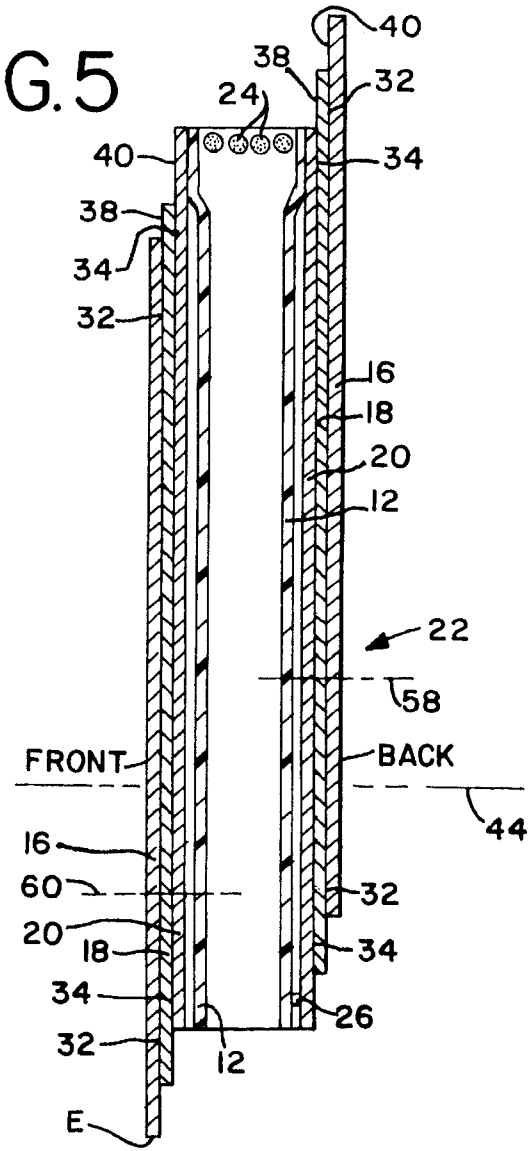

FIGS. *4a–h* show steps in the formation of the multi-ply plastic lined bag with satchel bottom, as follows:

FIG. *4a* is a front elevational view of a tube blank with slits at the two outermost of three paper plies for the folding and adhesive bonding of the satchel bottom;

FIG. *4b* is a front elevational view of the tube blank, partially cut away to show the heat sealing across the bottom end of the seamless plastic pouch and marginal offset thereof;

FIG. *4c* is a front elevational view of the tube blank showing a main score or creasing line for the initial folding of the satchel bottom;

FIG. *4d* is a front elevational view of the tube blank with the multiple paper plies at one side of the bag being folded upwardly around the main score line to thereby define upper and lower paper flaps and four diagonal bend lines in the paper ply flaps, both above and below the main score line, and foldably holding at the upper flap the sealed bottom portion of the plastic liner;

FIG. *4e* shows the front elevational view of the opened tube blank as in FIG. *4d* additionally showing upper and lower secondary score lines for the closure of the satchel bottom;

FIG. *4f* shows the opened bottom as in FIG. *4e* but having thereon the adhesive applied to geometric zones on the multiple paper plies for the subsequent adhesive closure of the satchel bottom;

FIG. *4g* shows the upper and shorter flap of the satchel bottom folded upon itself around the secondary score line for the adhesive attachment of the multiple paper plies at one side of the tube blank; and, FIG. *4h* shows the folding of the lower and longer flap around the other secondary score line to also fold back on itself and overlap the shorter flap to complete the adhesive closure of the satchel bottom;

FIG. 5 is a vertical cross-sectional view of a tube blank for the bag showing the blank prior to the heat sealing across the bottom of the tubular plastic liner;

FIG. 6 is a vertical cross-sectional view as in FIG. 5 and schematically showing the application of heat to seal the plastic pouch bottom and in a condition just prior to the slitting as shown in FIGS. *4a* and *4b;*

Figure 1:
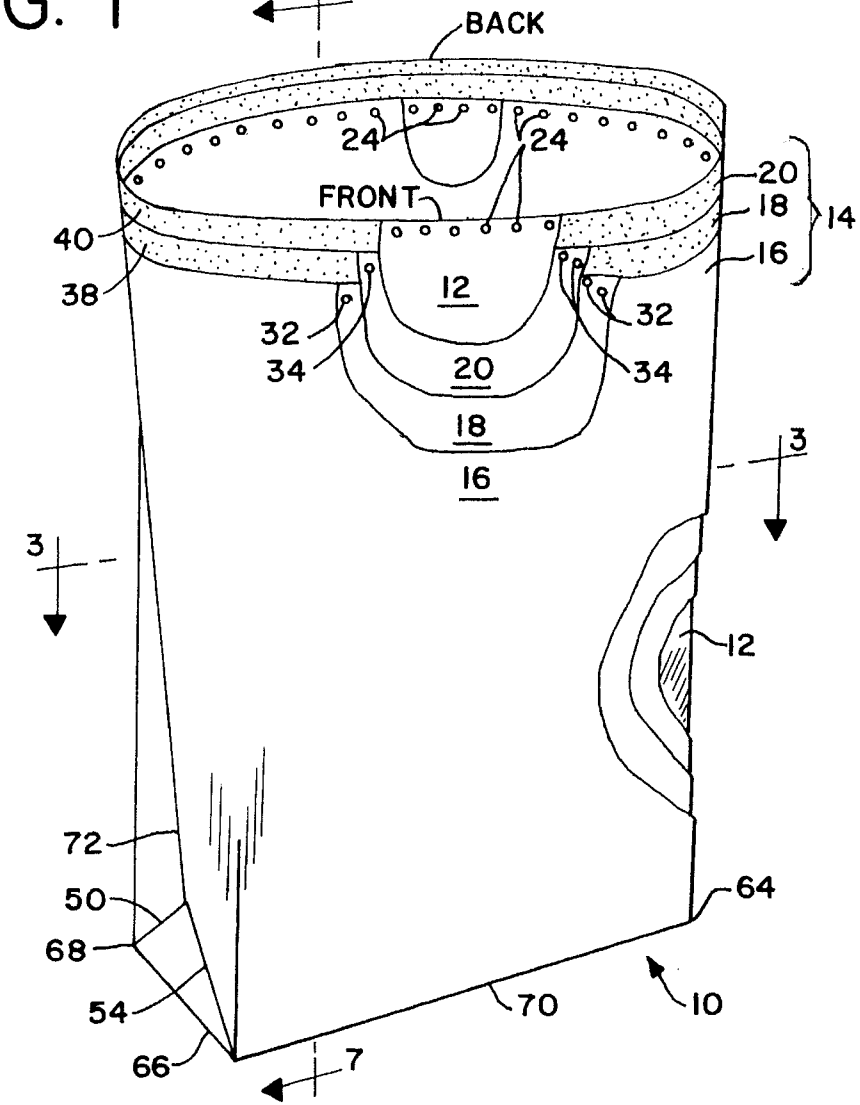
Figure 7:
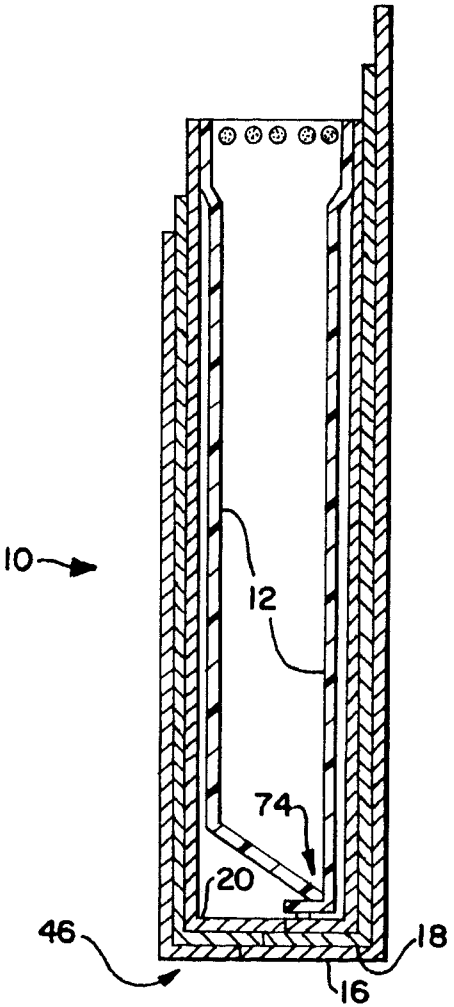
Figure 8:
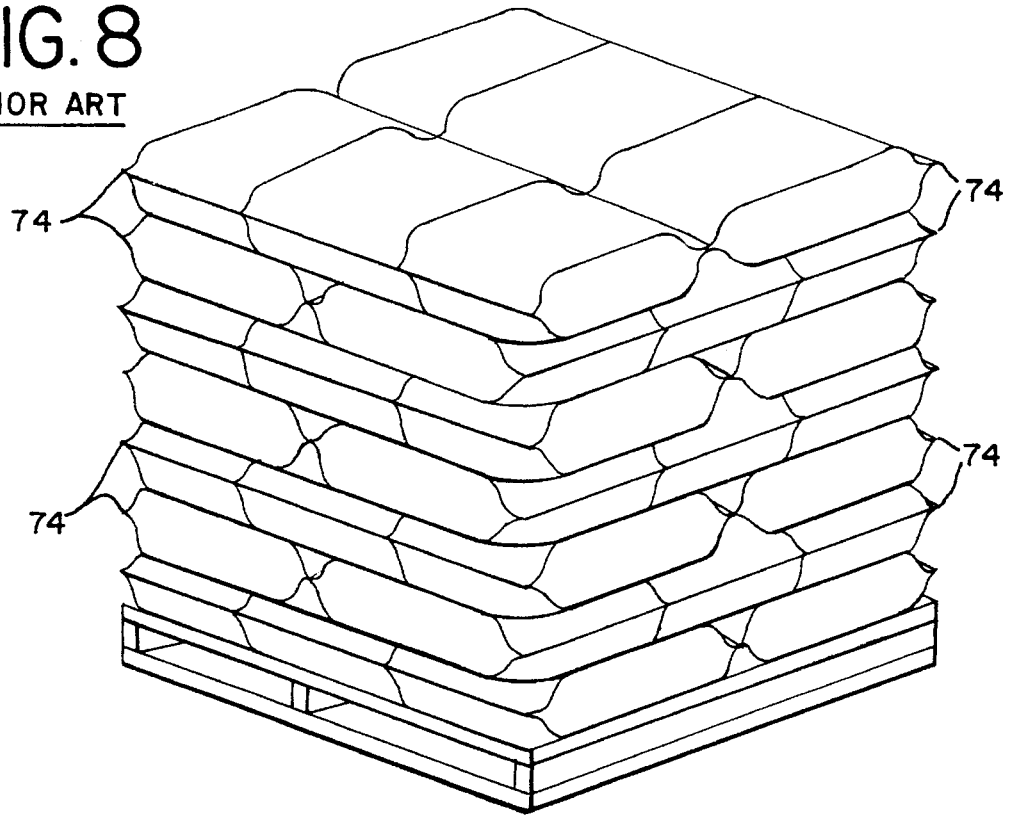
FIG. 8 PRIOR ART
Figure 9:
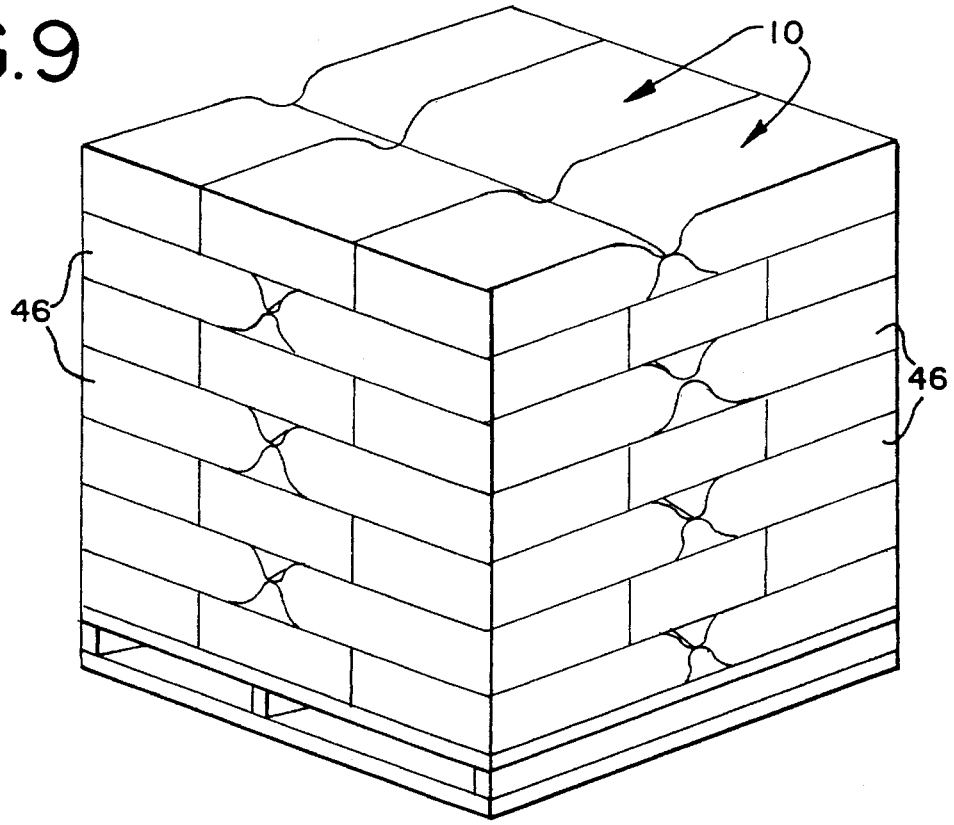

FIG. 7 is a vertical cross-sectional view of the bag of FIG. 1 taken along the line 7—7 looking in the direction of the arrows and showing the satchel bottom closure of the paper plies and the plastic pouch in condition ready for filling;

FIG. 8 is a perspective view of a pallet loaded with filled bags of the prior art pillow-type of package having pinch-bottom closure, and illustrating the pointed corners of the bags that are exposed on the finished load; and, FIG. 9 is a perspective view of a pallet loaded with filled bags made in accordance with the invention and showing the smooth brick pattern of the exposed ends of the filled bags.

Figure 11:
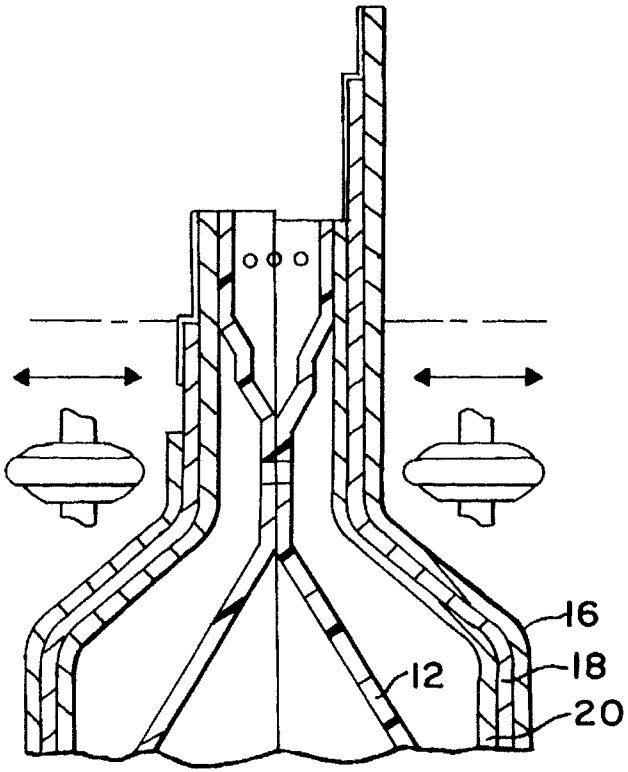
Figure 10:
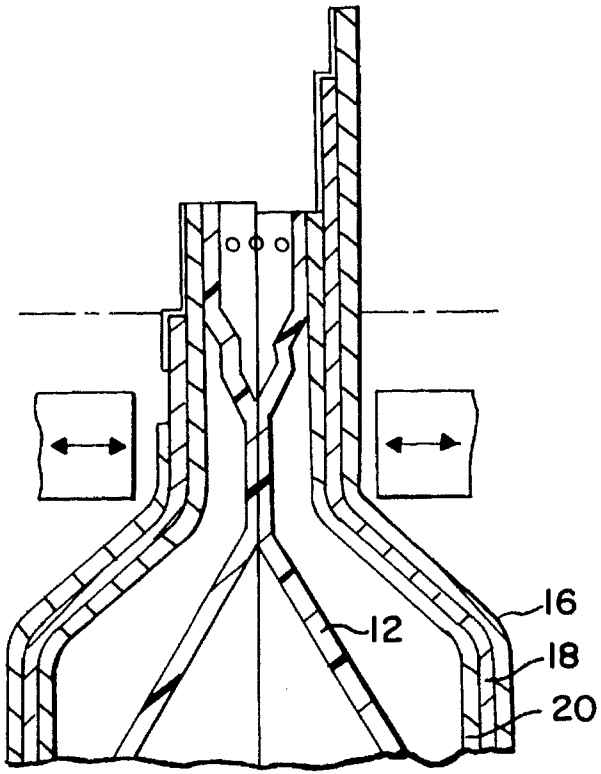
Figure 12:
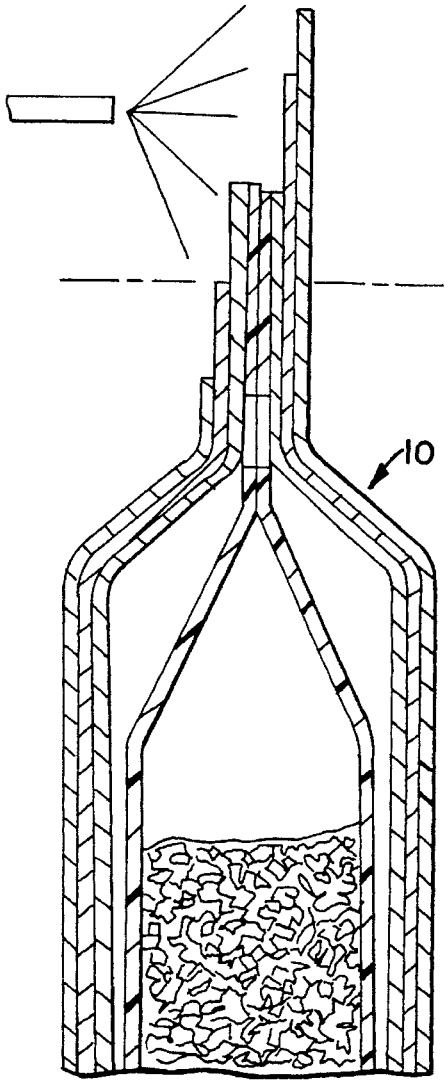
Figure 13:
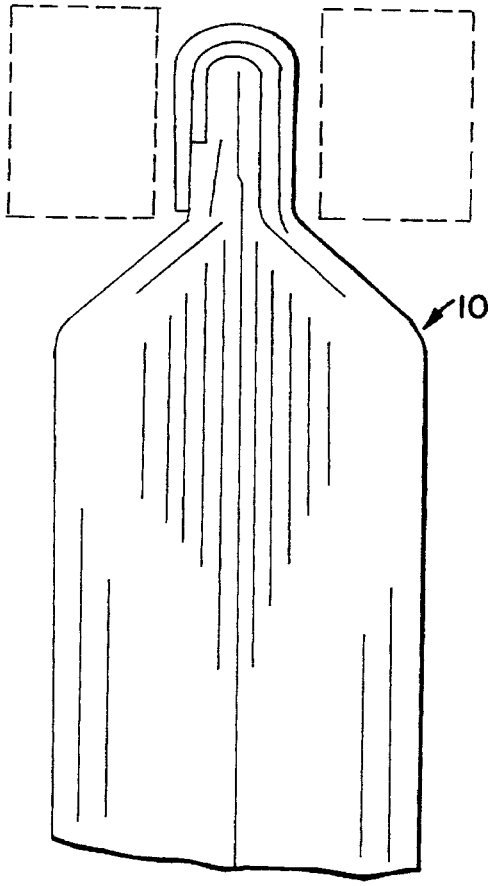

FIG. 10 is a vertical cross-sectional view of the bag in accordance with the invention filled with the product and showing a heat sealing across a top zone of the inner plastic ply thereby forming a closed pouch;

FIG. 11 is a vertical cross-sectional view of the filled bag showing the severance of the inner plastic pouch during the heat sealing at the top of the bag;

FIG. 12 is a vertical cross-sectional view of the upper portion of a filled bag in accordance with the invention illustrating a heating device for liquefying a hot melt adhesive previously applied to the upper ends of the outer paper plies; and, FIG. 13 is a side view of the upper portion of the filled bag with the outer paper plies folded over for passage between pressure rollers to close the bag or alternatively through a sewing machine to stitch close the paper plies thereat.

DETAILED DESCRIPTION OF THE INVENTION

Figure 2:
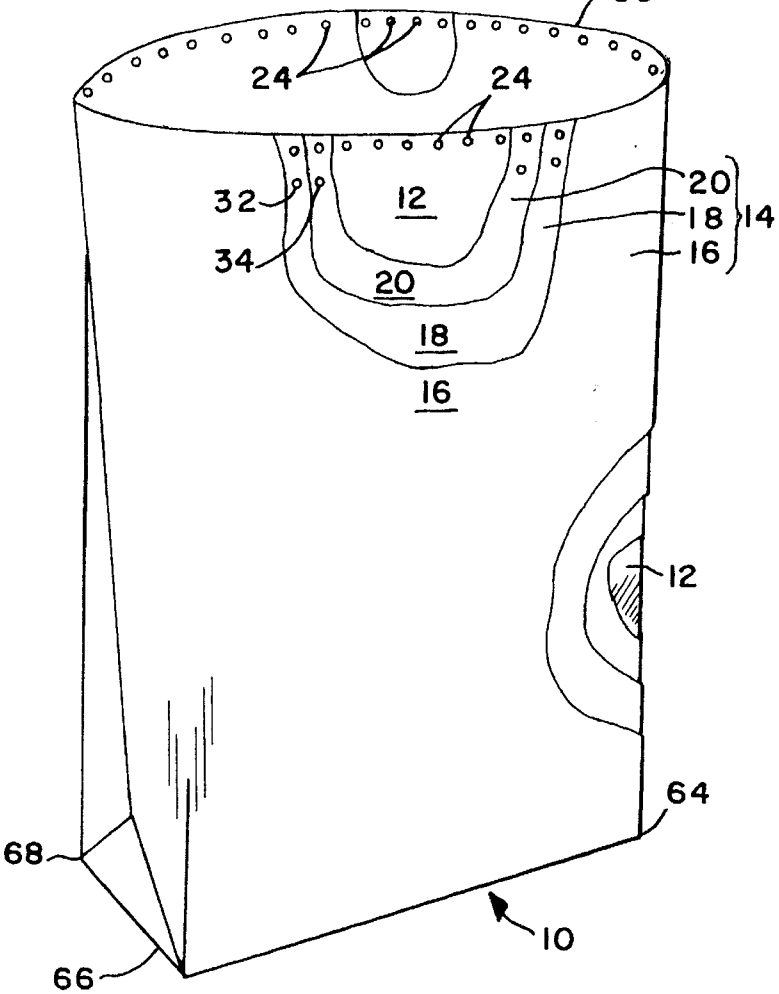
FIG. 2 is a perspective view of another form for the open top of the bag, also shown partially broken away, providing a flush-cut sewn, open end closure as an alternate to that shown in FIG. 1.

Throughout the Figures, like reference numerals are used to denote the same elements. Reference numeral 10 is used to designate a bag having multiple paper plies, plastic lined, and having a satchel bottom all in accordance with the invention. FIGS. 1 and 2 show completed bags 10 ready for filling wherein the bags differ only in the open end closure they employ, which closures are examples among many other kinds of closures that may be used with the invention. The open end closure used largely depends upon what may be required for a particular commodity to be packaged.

Figure 3:
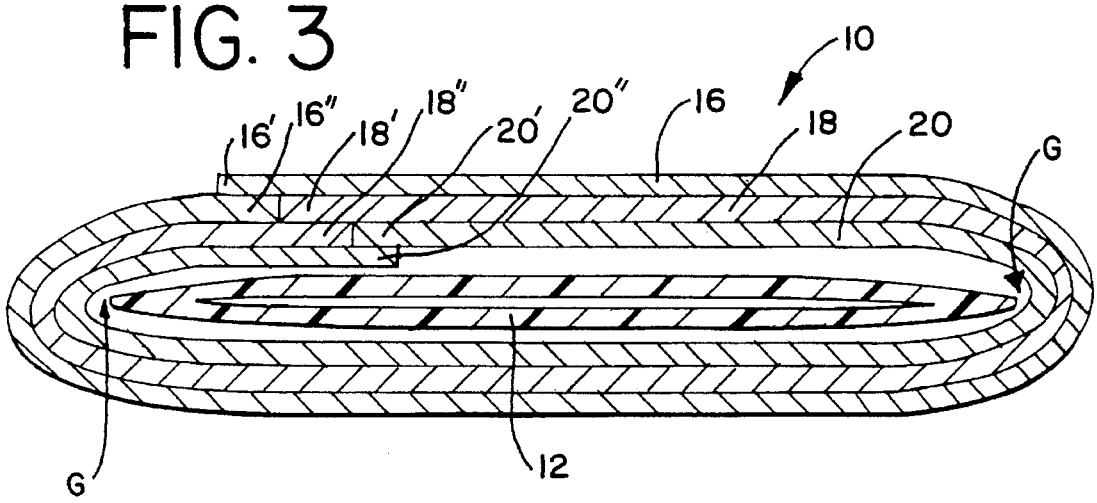
FIG. 3 is a horizontal cross-sectional view of the bag as shown in FIG. 1 taken along line 3—3, looking in the direction of the arrows.

With more specific reference to FIG. 1, the completed bag 10 made in accordance with the invention comprises an inner tubular ply 12 of heat sealable material. The material may be polyethylene, or equivalent. The term "inner tubular ply" is also interchangeable herein, and in the industry, with the terms "liner", "pouch", "plastic", or "poly" liner. The inner tubular ply 12 is disposed within a multiple ply outer tube 14 formed of a plurality of contiguous laterally offset plies 16, 18 and 20. The plies 16, 18, 20 are made of a non-heat sealable material, preferably paper, such as is used in well-known industrial packaging bags sold by Bemis Company, Inc. under its trademark AIRE-TITE. The cross-sectional view of FIG. 3 shows the lateral offsetting of the plies 16, 18, 20 in a known way. In more detail, the contiguous plies 16, 18, 20 are laterally offset, or shifted, one to the other, so that vertical overlapping edges form seams that are spaced laterally around the bag 10. In this way, ply 16 is overlapped at edges 16' 16", which overlap is in turn laterally offset from the overlapping edges 18', 18" of ply 18. The ply 20 is overlapped at edges 20', 20", which overlap is also offset from, but at the other side of, overlapping edges 18', 18". The inner tubular ply 12 comprises a seamless heat sealed tube that is fed to a bag making device, which forms a bag blank. The inner tubular ply 12 is narrower in width than one-half the perimeter of the paper ply 14. This results in a lateral space, or gap, G between the poly liner 12 and inner most paper ply 20 as best shown in FIGS. 3 and *4b*. The tubular blank is generally designated at 22, as shown in FIG. *4a*, which blank may be produced on a conventional stepped end tuber device. Because the plastic ply 12 is heat sealed, it is seamless. The overlapping edges of the multiple paper plies 16, 18, 20 are adhesively bonded to form the seams along the overlaps, preferably by applying a hot melt adhesive. As the blank 22 is formed, the plastic ply 12 is circumferentially bonded at 24 adjacent the top edge of the paper ply 20, which ply is the innermost contiguous paper ply. The bonds 24 are a series of dots of adhesive around the circumference of the inner tubular ply 12 generally near the open end. However, below the bonds 24, the inner ply 12 is freely and non-attachably retained within the paper ply 14, except for three temporary dots of adhesive 26 shown in FIGS. 5 and 6 at the back side and near the bottom of the tube blank 22, which momentarily aid in the bottom folding process to form the bag. After completion of the bag, they serve no function, dissipate, and do not impede the loose folding of the bag, or its ability to be retained in a fully detachable manner within the paper plies. The paper plies 16, 18, 20 are bonded together by dots of adhesive extending circumferentially around and near the top open end of the blank 22, as shown at reference numerals 32, 34. The dots of adhesive 32 are provided to adhere ply 18 to ply 20 and dots of adhesive 34 are provided to attach ply 16 to ply 18. The line of dots of adhesive 32, 34 are also referenced in FIG. 5, which further illustrates how they are longitudinally offset front to back due to the stepping of the paper plies 14.

The embodiment of the open top in FIG. 1 has a stepped arrangement of the plies 16, 18, 20 as is also illustrated in FIGS. 5–7. The embodiment of FIG. 2 is a flush cut top, wherein the plies 16, 18, 20 are cut straight across with the top of the plastic liner 12 to provide a common upper periphery 36. In FIG. 2 the closure of the paper ply 14 would be by sewing. The plastic liner 12 would still be heat sealable and severable, as in FIG. 1.

The closure of the open top of FIG. 1 is accomplished by reactivation of a hot melt adhesive strip 38 located on ply 18 and a hot melt adhesive strip 40 located on ply 20. The hot melt adhesive strips on the stepped front and back sides are longitudinally offset due to the stepping, so that the upper end may be passed through a folding machine, and by means of pressure rollers, the stepped plies 16, 18, 20 are overlapped and adhesively joined in a standard way as explained in U.S. Pat. No. 5,281,027.

Also in regard to closing the top end, the upper end of the plastic liner 12 would be heat sealed to closure and then, in preferred form, severed by pressure rollers applied to the exterior of the paper ply 20, whereby the plastic liner 12 will detach below the line of adhesive dots 24 to result in the freely detachable arrangement of the pouch 12 as a bag-in-a-bag.

The closure of the upper end of plastic liner 12 of FIG. 2 is also accomplished by heat sealing the plastic to closure and, preferably, severing it in the same way. However, the paper plies 14 are closed by means of sewing them together and possibly incorporating a tear strip along the closure in a known way.

It should be understood that other types of closures are alternately envisioned for the open end of the present inventive bag 10, including a pinch-type closure, adhesive closures other than reactivatable hot melts, or mechanical closures, such as staples, clasps, zipper locks, etc. The preferred form of the invention, regardless of how the paper plies are closed, envisions the heat sealing and severance of the top of the plastic pouch 12 so that the bag is detached thereat.

In connection with any of these types of open end closures, the formation of the satchel bottom of the bag will now be described in connection with the stages of the formation of the bag 10 as shown in FIGS. 4*a–h*.

Figure 4A:
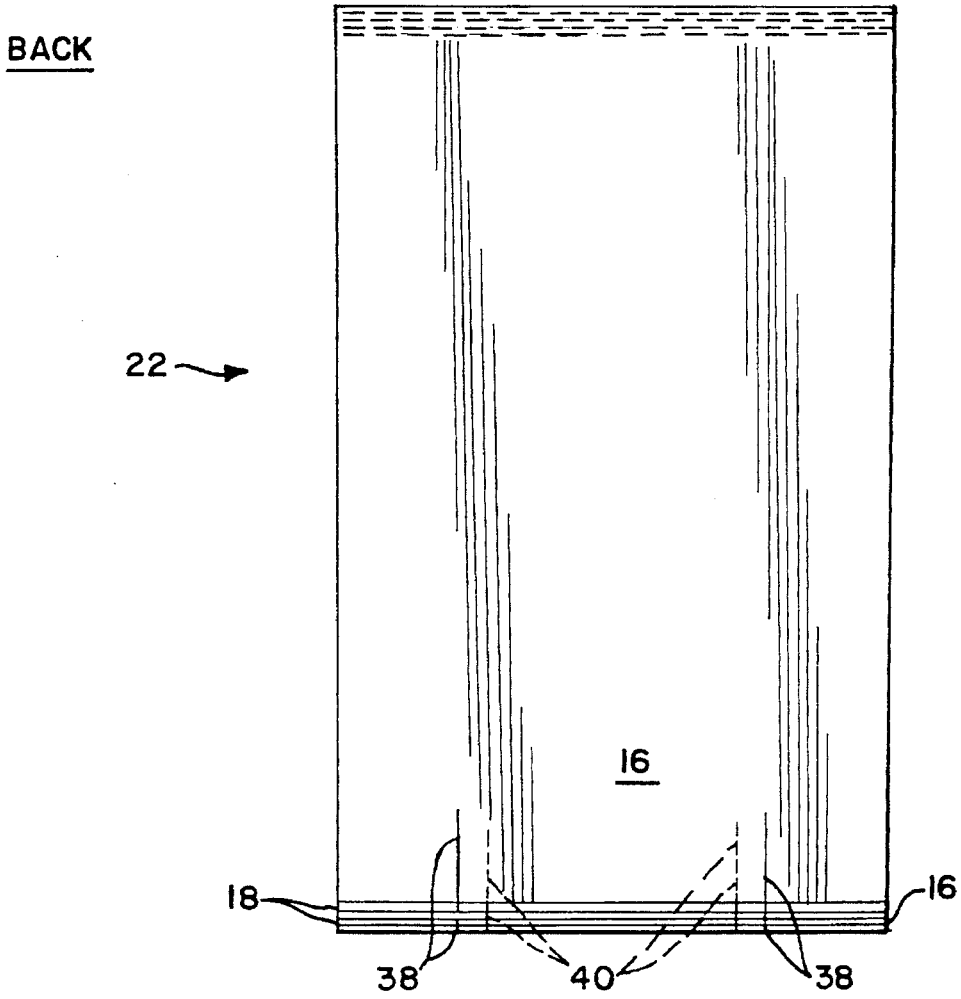

As previously noted, the bag blank 22 is illustrated in FIG. 4*a* in the first step of forming the satchel bottom. FIG. 4*a* is the "back" side of the bag 10 for purposes of explanation. Slits are first cut through the front and back sides of exterior ply 16 whereby two parallel slits 38 are made in the front side and two parallel slits 38 are made in the back side of ply 16. Next, two parallel slits 40 are cut through both the front and back plies 18 as shown in dashed lines in FIGS. 4*a* and 4*b*. In the disclosed embodiment, the slits 38 are about 3 inches long, made about 4 to 4½ inches inwardly of the lateral edges of the bag. The slits 40 are approximately 2½ inches long and inwardly parallel to slits 38 at about ¾ to 1 inch. The width of the bag 10 measured across the blank 22 at the outer ply 16 is standard size in the range of about 19½ to 20 inches. Each pair of slits is cut through the bottom edge of the respective ply. These dimensions are useful for understanding the preferred embodiment, but are not to be understood as limitations to the invention. While the preferred embodiment has a non-slit innermost ply 20 and two overlying slit plies 16, 20, the invention envisions a bag 10 with from 2 to 6 paper plies overlying the ply 20; the inner ply 20 being non-slit and the others being slit wherein each ply is slit inwardly at about a ½ to 1 inch distance parallel to the slits of the preceding adjacent overlying ply. The slits are sequentially shorter by ¼ to ¾ inch less than the preceding overlying ply. The goal is to optimize the lateral distance between the slits on sequential plies so that later exposed geometric zones of adhesion surfaces are maximized for effective bonding.

Figures 4B, 4C, 4D:
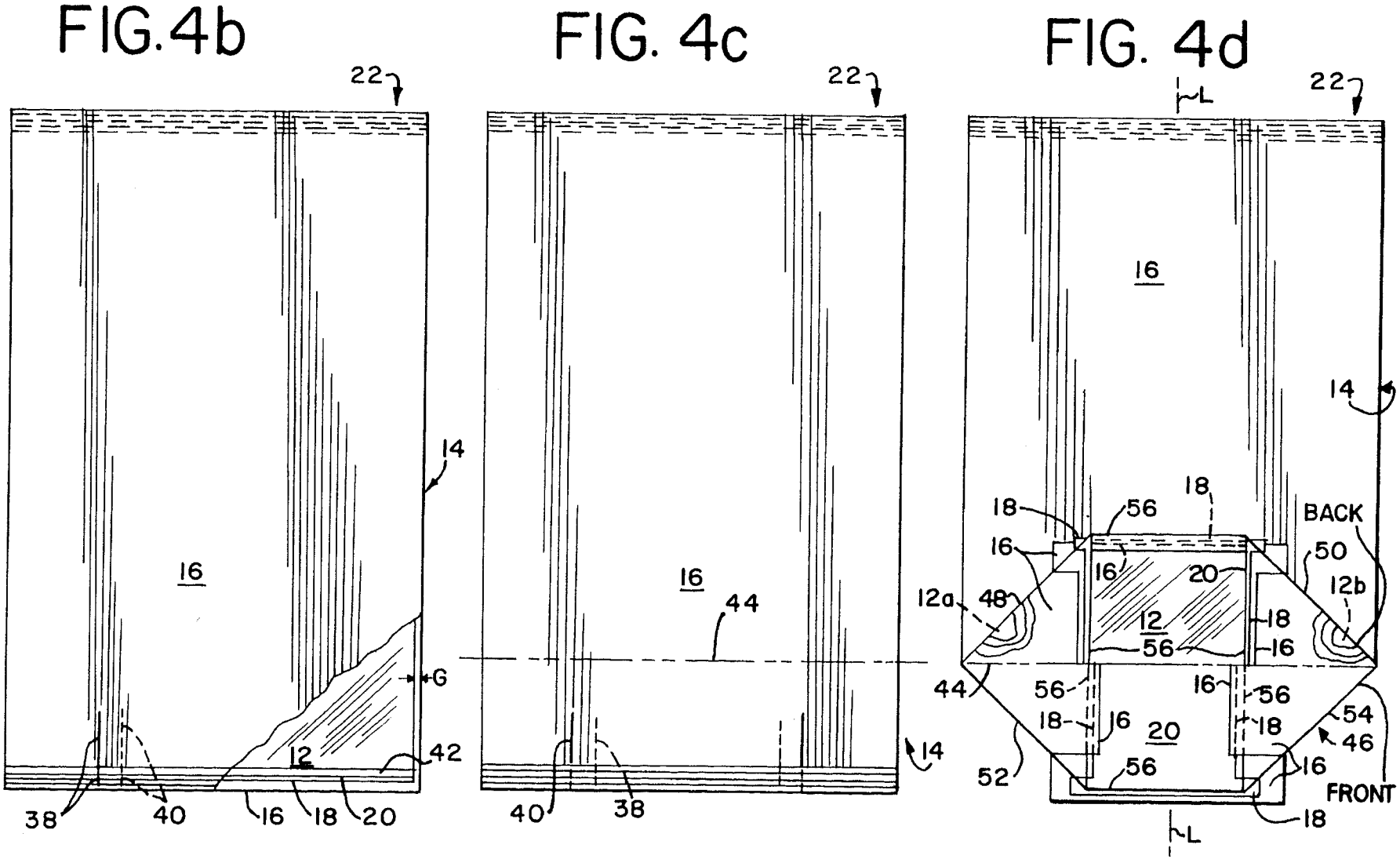

With reference to FIG. 4*b*, the lower righthand corner of the front side of the blank 22 has been broken away to expose the inner plastic liner 12. The gap G, laterally offsetting the plastic ply 12 from the plies 14, is indicated. It is ¼ inch in the exemplary embodiment. As part of the blank forming process, the plastic liner 12 is heat sealed to closure along its lower edge forming a heat sealed strip 42. The bottom edge of the plastic liner 12 being closely adjacent and parallel to the lower edge of the innermost ply 20, as also shown in FIG. 6.

In FIG. 4*c*, a main score or crease line 44 is made transversely across the outer tube 14 and thereby across all paper plies 16, 18, 20. Also with reference to FIG. 5, in the disclosed embodiment the main score line 44 is made about 8 inches upward from the bottom edge E of the front side outer ply 16. The score line 44 will become the transverse center axis of the bottom of the satchel bottom as will be understood hereinafter.

In FIG. 4*d* the satchel bottom of the bag takes on a more clearly definable form and is generally denoted by reference numeral 46. The steps represented in FIG. 4*d* are the foldings back of the plies 16, 18, 20, with the poly liner 12 only folded to one side of the main score line 44. Thus, the poly liner 12 is retained at one side of the main score line and is tucked in triangular folds 12*a*, 12*b* resulting from the diagonal fold lines 48, 50 of the outer tube 14. The back plies 16, 18, 20 are similarly arranged to create diagonal fold lines 52, 54. It will be apparent that the non-slit innermost paper ply 20 maintains a continuous lower edge generally denoted at 56. The paper plies 16, 18, 20, in addition to the plastic liner 12, have the diagonal bend lines 48, 50, 52, 54, in common, which, by virtue of the stepped arrangement of the outer tube 14 and the slits 38, 40, create various symmetric geometric exposed zones for adhesion as shown. These zones will be subsequently functional as areas of very effective adhesive mating for completing the satchel bottom 46, as will be explained in regard to FIGS. 4*f–h*. The blank 22 for forming the satchel bottom 46 is not symmetrical about the main score line 44 but is symmetrical about the longitudinal central axis L of the blank 22.

Figure 4E:
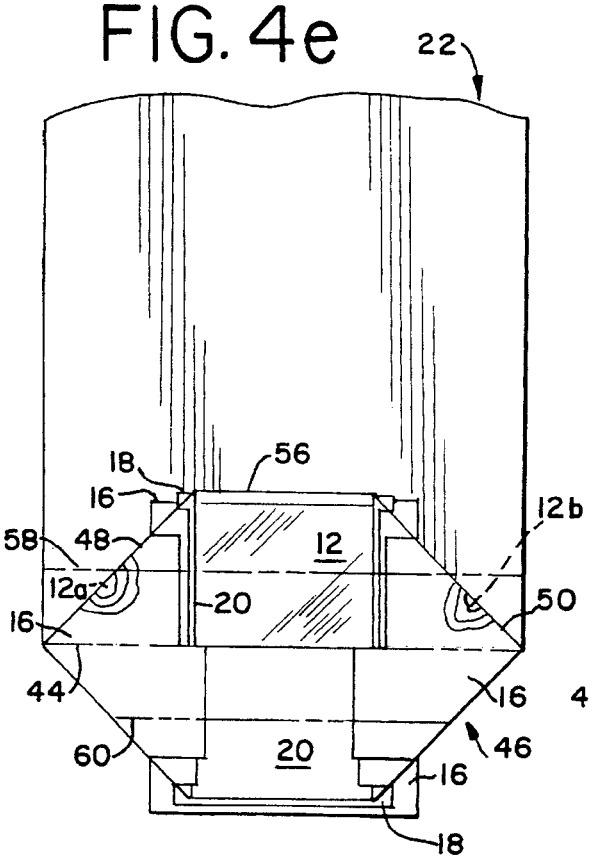

FIG. 4*e* illustrates the next step, namely the formation of secondary score lines 58, 60, which are equidistant from and parallel to the main score line 44. In the disclosed embodiment they are spaced about three inches to either side of the main score line 44. Since the stepping of the plies 16, 18, 20, longitudinally offsets the front and back plies (FIGS. 5–7), the relative upward folding of the back plies shown in FIGS. 4*d* and 4*e* causes the folds above score line 44 to form shorter flaps than front side ply flaps below score line 44. In the disclosed embodiment, the offset of the front side to back side plies caused by the stepping of the plies 14 is about 1 inch. Thereby, when the secondary score lines 58, 60 are formed, the portion of the front side plies below score line 60 has a greater length than the back side plies above score line 58, as would be understood with reference to FIG. 5. The score lines 44, 58, 60 are all shown in FIG. 5 for purposes of explanation. It should be understood that the plastic liner 12 will receive a crease along the score line 58, as well as the paper plies that envelop it.

Figure 4F:
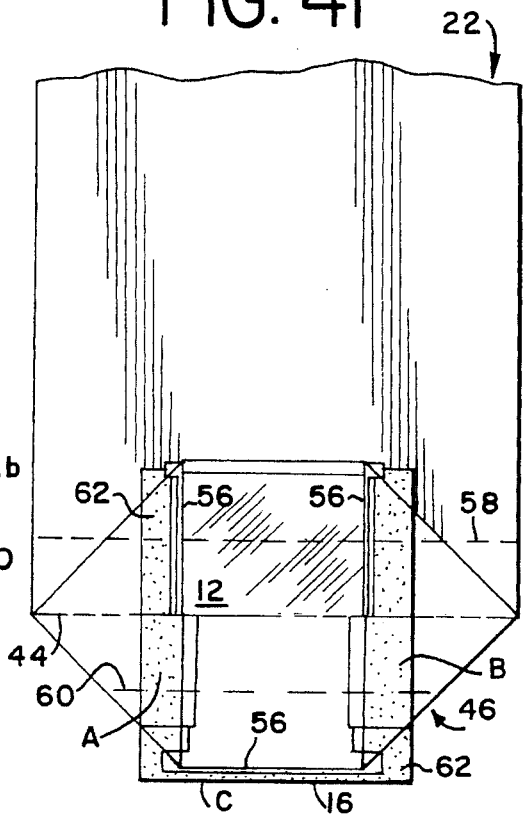

The next stage in the formation of the satchel bottom 46 is illustrated in FIG. 4*f*. An application of adhesive 62 is shown with stippling in the geometric zones of adhesion on the papers plies 16, 18, 20 created by the slitting 38, 40 and the folding of the plies about the main score line 44. As stated, this folding creates the diagonal bends 48, 50, 52, 54 whereby a very effective series of geometrically exposed opposable surface areas are created, allowing for strong contact bonding of the adhesive 62. The adhesive securement pattern provides great advantage over the prior art techniques wherein slitting and stepping of the paper plies is not provided in this way. This formation or pattern also allows for the free non-adhesive retention of the folded poly liner 12, as shown at the broken-away triangular shaped folded portions of the paper plies (FIGS. 4*d* and 4*e*) that cover parts 12*a* and 12*b* of the poly liner. It will be seen that the poly liner 12 above score line 44 assumes a generally trapezoidal shape bounded by the score line 44, diagonal folds 48, 50, and a portion of the innermost paper ply 20, generally along the edge 56 extending between the diagonal folds 48, 50 (FIGS. 4*d*, 4*e* and 4*f*). The adhesive 62 preferably comprises a hot melt glue and is applied in two relatively parallel zones A, B, which zones are bordered by the edge 56 above the main score line 44, so as not to contact the poly liner 12. The zones A, B extend lengthwise past the secondary score line 60 to the bottom edge, of the paper ply 16 to meet an adhesive zone C. The zone C is bordered at an upper edge by a part of the continuous edge 56 of the innermost ply 20 and is generally parallel to the score line 60.

Figure 4G:
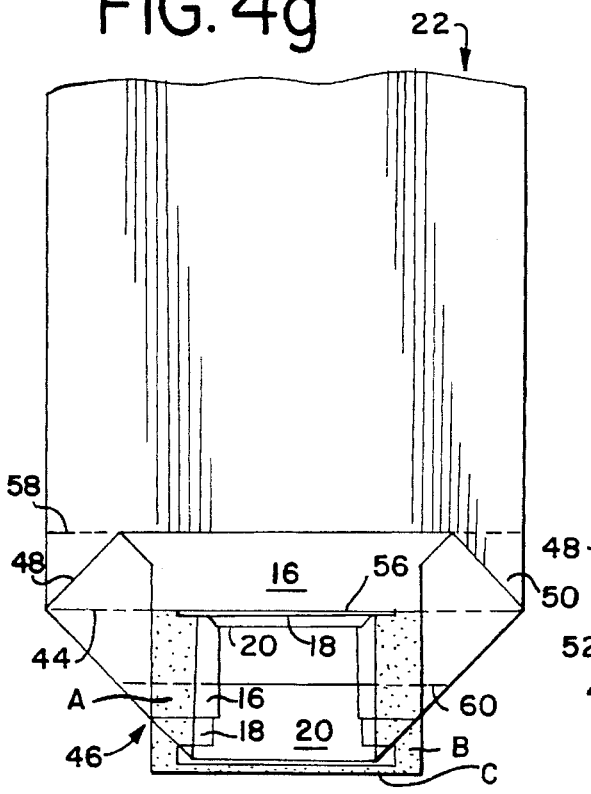

With attention directed to FIG. 4*g*, the shorter paper ply flaps, i.e., the back side plies above score line 44 as shown in FIG. 4*f*, are rotated or folded about secondary score line 58. This step folds the back side paper plies 16, 18, 20, generally onto themselves and their respective portions of zones A and B, which also rotates and secures the plastic liner along the fold line 58 thereunder. At this stage, the inner plastic liner 12 is bent along diagonal bends 48, 50 and at the crease formed along secondary score line 58.

Figure 4H:
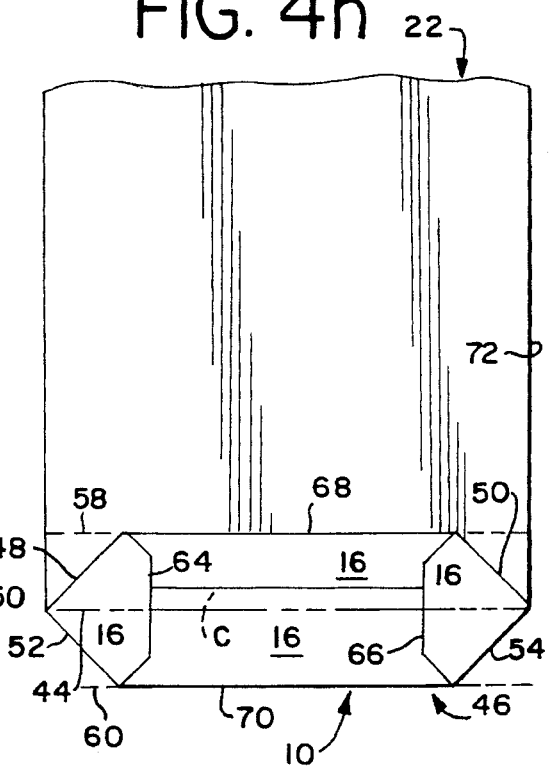

Turning now to FIG. 4*h*, the completion of the satchel bottom 46 is achieved by folding the longer ply flaps of the front side of the paper plies 16, 18, 20 about the secondary score line 60, and thereby rotating the adhesive zone C to overlie the paper plies 16, 18 20 of the back side of the bag 10. This step also folds the respective portions of the zones A, B of the front side longer flaps onto themselves. Each of the surfaces with reference numeral 16 indicate the exposed bottom surfaces of the satchel bottom which are comprised of the outer paper ply 16. Upon the drying of the adhesive in zones A, B and C, satchel bottom 46 is completed. The steps for forming the tube blank 22 are thereby also completed. The multi-ply plastic lined bag with satchel bottom 10 is now in a flat blank stackable form, ready for shipment to the manufacturer, packer, or the like, for filling with a product.

When the bag 10 is ready for filling, the satchel bottom 46 is unfolded to form a flat rectangular bottom shape, as shown in the cross-sectional view of FIG. 7 and also as illustrated in FIGS. 1 and 2, whereby the open mouth top is positioned for the introduction of a product, typically a dry granulated powder, such as milk granules, or the like. The short sides of the rectangular bottom are the overlapped edges of the paper plies, generally denoted at 64, 66 in FIGS. 1, 2 and 4*h*. The longer edges of the rectangular bottom are denoted at 68, 70, which are the fold lines of the paper plies along secondary score lines 58, 60, respectively. At each corner of the bag, adjacent the short edges 64, 66, a triangle is formed with the diagonal bend lines, as at 50, 54, noted in FIG. 1. The lateral edge of the bag 10 will taper to meet the intersection of the diagonal bend lines 50, 54, shown at one side of the bag for illustration, at reference numeral 72 in FIG. 1. The mirror image of course is formed on the opposite side of the bag, not shown in FIGS. 1 and 2.

It will be appreciated with reference to FIGS. 1, 2, 4*h* and 7, that the satchel bottom bag 10 can be filled on conventional PBOM filling equipment.

FIG. 7 is a schematic cross-sectional view showing the bag 10 with the satchel bottom 46 fully deployed, wherein the overlap adhesive attachments of zones A, B, C, results in the offset arrangement of plies 16, 18, 20. Interiorly of the bag 10, the plastic liner 12 is shown ready for receipt of the product therein. A lower end of the bag 74 is shown detachably released from the paper plies which had held the ply 12 at diagonal bends 48, 50 and at the secondary score line 58. The secondary score line 58 will be understood as also forming the side 68 of the satchel bottom 46, as shown in FIG. 4*h*. As a result, the inner plastic liner 12 is freely retained at the satchel bottom 46 and by virtue of the marginal offsets G, may be fully deployed interiorly of the bag 10 for receipt of a commodity without rupture damage, pinholing, or becoming pinched at the corners or edges of the folded plies of the satchel bottom 46. In the preferred embodiment, the ply 12 has width of ½+/–¼ inch less than one-half of the perimeter of paper ply 20, so that gap G is formed along opposite lateral edges of the ply 12 offsetting it from the paper ply 20.

FIGS. 10–13 show further procedures affecting the top of the bag 10 for closing it as in said U.S. Pat. No. 5,281,027. In FIG. 10, heat bars are shown for heat sealing closed the top end of the plastic liner. FIG. 7 shows pressure rollers for severing the bag thereat to be free at the top. FIG. 12 shows a heat application to the paper plies wherein hot melt adhesive is reactivated to seal close the paper plies. The plastic liner is shown severed as in regard to the step of FIG. 11. FIG. 13 shows the folding-over of the paper plies which may be optionally pressed together by rollers located at the dashed line squares or alternately by sewing needles located at the dashed line squares to close the top of the bag, and optionally by also including a tear strip or the like in a conventional way. The plastic liner is shown heat-severed at the top, as in FIG. 12.

FIG. 8 is a perspective view of a loaded pallet utilizing prior art, pinch bottom, open mouthed bags, wherein the pinch bottom closures create corners 74 that can be damaged or ruptured on contact with a forklift, or other handling equipment. Additionally, pallets of loaded bags are often wrapped in a shrink wrap type plastic for protecting the commodities, particularly where the bags might contain granulated food products, such as dry milk powder. The sharp corners 74 can puncture the plastic wrap and defeat its purpose. On the other hand, FIG. 9 illustrates the palletization of a collection of bags 10 made in accordance with the invention, wherein the satchel bottoms 46 form brick-like square corners which can be neatly stacked to provide even smooth surfaces and the avoidance of sharp corner damage. These smooth exposed rectangular surfaces at the satchel bottoms 46 also allow for the printing or marking of indicia, labels, warnings, notices, code numbers, and the like, which can be helpful in monitoring inventory.

The invention advantageously provides a satchel bottom bag 10 that can be made in a flat tube arrangement, as shown by the blank 22 in FIG. 4*h*, for filling on conventional PBOM tubular bag-filling equipment to thereby avoid the need to use standard gussetted satchel bottom bags, which require special filling equipment. Thus, a manufacturer or packager need only have one type of filling machine for filling either standard PBOM bags and the satchel bottom bag 10 made in accordance with the invention.

While specific embodiments of the present invention have been shown here for the purposes of explaining a preferred embodiment of the invention, it is to be understood that the appended claims have a broader range than the embodiment disclosed.

What is claimed is:

1. A tubular non-gussetted multiple ply paper bag with seamless plastic inner pouch, the bag having a non-satchel open end and a closed satchel bottom end, said closed satchel bottom end comprising a non-slitted folded paper ply and at least one slitted folded paper ply folded to non-adhesively, and foldably, retain a free bottom end of said plastic inner pouch, said plastic inner pouch being permanently heat sealed to itself and sealingly close said free bottom end, said plastic inner pouch further being laterally offset from said paper plies along marginal edges thereof, said paper plies being stepped only in a direction lengthwise of the bag, each ply having an adhesively bonded seam, the seams being laterally offset from each other, whereby said bag is capable of receiving a product therein and forming a rectangular bag bottom at said closed satchel bottom end, and said plastic pouch being heat sealable at said open end for fully enclosing a product therein.

2. The bag as claimed in claim 1 wherein said paper plies comprise front side plies and back side plies and wherein said paper plies forming said closed satchel bottom end are folded into front side and back side plies, wherein said plastic liner is foldably retained within folded paper plies at only one of said sides.

3. The bag as claimed in claim 1 wherein said plastic liner is of a width in the range of ½ inch+/−¼ inch less than the width of said paper plies.

4. The bag as claimed in claim 1 wherein said paper plies comprise an innermost paper ply that is non-slitted at said satchel bottom, a plurality of slitted paper plies stepped lengthwise therefrom, and the plies being folded at said satchel bottom.

5. The bag as claimed in claim 1 wherein said plastic pouch is adhesively attached to said paper plies only at said open end of the bag and is otherwise detachably and non-adhesively disposed within said paper plies.

6. The bag as claimed in claim 1 wherein said paper plies have geometric overlapping zones of adhesive bonding adhesively securing folded portions of the plies together at said closed satchel bottom end and wherein said inner plastic pouch is spaced from said overlapping zones.

7. A flat non-gussetted tubular bag having an open end and a closed end comprising:

at least two paper plies being laterally offset, each being adhesively bonded along a seam thereof, and at least two of said paper plies being stepped relative to each other only in a direction longitudinal of the bag;

a seamless inner plastic liner being attached to an innermost of said paper plies at said open end of the bag and having a width less than one half the perimeter of the innermost paper ply, said plastic liner further being heat sealed to itself to be sealed closed at the closed end of said bag and thereby form a plastic pouch;

said closed end of said bag having a satchel bottom capable of forming a rectangular bottom of the bag when filled, said satchel bottom being formed by folds of said paper plies being folded about three score lines, one score line being a generally central transverse main score along the bottom of the bag and the other two being parallel secondary score lines equidistant from the main score line, said innermost paper plies being non-slitted and at least one other paper ply being slitted, said folded paper ply having means to form geometric zones of adhesion, an adhesive on said zones for securing said folded paper plies together, said inner plastic liner being detachably and non-adhesively retained at said satchel bottom, and the plastic pouch being folded about said main score line and one of said two secondary score lines.

8. The bag as in claim 7 wherein said inner plastic liner has a width in the range of about ½ inch+/−¼ inch less than one-half of the perimeter of the innermost paper ply.

9. The bag as in claim 7 wherein said at least two paper plies comprise a number of paper plies in the range of from about 2 through 6 plies.

10. The bag as in claim 7 wherein said satchel bottom folded paper plies have shorter paper ply flaps at one side of said main score line than paper ply flaps on the other side, said inner plastic liner being foldably retained at one of said paper ply flaps.

11. The bag as in claim 10 wherein said inner plastic liner is retained at the shorter of said paper ply flaps, and said inner plastic liner being capable of heat sealable closure generally at said open end upon the receipt of a product therein and wherein said open end of said paper plies include means for closing said open end to enclose said plastic liner therein.

12. A multiple ply plastic lined bag with a satchel bottom, the bag containing a product within said plastic liner and absent contact with any other ply, said bag comprising:

an innermost tubular paper ply covered by at least one other tubular paper ply, said tubular paper plies each having a longitudinal seam, said seams being laterally offset from one another, at least two of said paper plies being stepped, wherein said steps being only in a direction longitudinal of the bag, said paper plies having upper ends opposite said satchel bottom;

said plastic liner extending for substantially the full length of said paper plies and being marginally offset from the lateral edges of said paper plies whereby to have a width less than one-half the perimeter of said paper plies, said plastic liner being sealed closed at a bottom end thereof at said satchel bottom;

said paper plies being folded and adhered to form the satchel bottom, the paper plies being folded about a major score line extending generally transversely across the satchel bottom and folded about at least two other secondary score lines parallel to the major score line, said innermost tubular paper ply being non-slitted and said at least one other tubular paper ply being longitudinally slitted at the satchel bottom, whereby said folded paper plies having geometric zones of adhesion which opposingly contact for adhesively bonding together the folded paper plies, adhesive on said geometric zones for adhering said folded paper plies and forming a rectangular bottom surface at said satchel bottom, and said sealed closed bottom end of said plastic liner being non-adhesively and freely removably retained at said closed satchel bottom; and, a product contained in, and only in contact with, said plastic liner.

13. A bag as claimed in claim 12 wherein said plastic liner includes a heat sealed closure at an upper end opposite said closed satchel bottom and wherein said paper plies are longitudinally stepped at said upper ends and adhesively bonded together independently of said plastic liner wherein said plastic liner is retained freely detachable within said paper plies.

14. A bag as claimed in claim 12 wherein said plastic liner has a heat sealed closure at an upper end opposite the satchel bottom and wherein said paper plies at said upper ends are flush cut and sewn to closure thereat independently of the plastic liner, wherein said plastic liner is retained freely detachable within said paper plies.

15. A flat tubular satchel bottom bag having multi-ply construction comprising: a number of tubular overlapping paper plies in the range of from 2 through 6 plies, said paper plies each having longitudinal seams, said seams being laterally offset from each other; a tubular plastic liner pouch extending within the paper plies from an upper end of the bag to a closed satchel bottom of the bag for substantially the full length of said paper plies, said plastic liner pouch being inwardly offset from an innermost of said tubular paper plies whereby to provide marginal gaps therebetween; the satchel bottom closure being formed by the folding and overlapping of said paper plies thereat, said innermost paper ply being non-slitted and said others of said paper plies being longitudinally slit at laterally staggered locations, said satchel bottom having a central, major transverse fold line defining flaps of plies to either side thereof and said flaps at either side of the major transverse fold being secondarily folded about secondary fold lines parallel to the said major fold line, whereby the flaps are folded upon each other and adhesively secured at geometric zones formed by the folded plies and said ply slits independently of said plastic liner pouch, said plastic liner pouch being folded about the major fold line and one of said secondary fold lines; and said plastic liner pouch being non-adhesively and detachably folded within one of said flaps at one side of said major fold line.

16. A flat tubular satchel bottom bag as claimed in claim 15 wherein said paper plies are stepped at said satchel bottom only in a direction longitudinal of the bag and thereby defining one of said flaps to be shorter than the other flaps, whereby said shorter flaps are overlain by the other longer flaps.

17. A flat tubular satchel bottom bag as claimed in claim 15 wherein at said upper open end of said bag said paper plies are longitudinally stepped, folded over, and adhesively bonded together.

18. A flat tubular satchel bottom bag as claimed in claim 17 wherein at said upper end said plastic liner pouch is heat sealed, severed and detachably spaced from said adhesively bonded paper plies.

19. A flat tubular satchel bottom bag as claimed in claim 15 wherein at the upper end of the bag, the paper plies are flush cut and sewn to closure.

20. A flat tubular satchel bottom bag as claimed in claim 19 wherein at said upper end said plastic liner pouch is heat sealed, severed, and detachably spaced from the sewn paper ply closure.

21. A flat tubular satchel bottom bag as claimed in claim 15 wherein said laterally offset slits comprise first parallel slits cut through the outermost ply of the bag and the slits in the other plies being sequentially cut parallel thereto laterally offset sequentially inward of said bag, wherein a paper ply immediately adjacent the plastic liner pouch has a pair of slits spaced closer to each other than any of the other pairs of slits in said paper plies.

22. A flat tubular satchel bottom bag as claimed in claim 15 wherein said plastic liner pouch has a width from ½ inch+/−¼ inch less than the width of the innermost paper ply thereby forming said marginal gaps therewith.

* * * * *